US005178686A

United States Patent [19]

Schmid et al.

[11] Patent Number: 5,178,686

[45] Date of Patent: Jan. 12, 1993

[54] LIGHTWEIGHT CAST MATERIAL

[75] Inventors: Eberhard E. Schmid, Alzenau; Manfred Rühle, Obertshausen, both of Fed. Rep. of Germany

[73] Assignee: Metallgesellschaft Aktiengesellschaft, Frankfurt, Fed. Rep. of Germany

[21] Appl. No.: 678,901

[22] Filed: Mar. 28, 1991

Related U.S. Application Data

[63] Continuation of Ser. No. 450,140, Dec. 13, 1989, abandoned.

[30] Foreign Application Priority Data

Dec. 20, 1988 [DE] Fed. Rep. of Germany ..... 3842812

[51] Int. Cl.[5] ..... C22C 21/08

[52] U.S. Cl. ..... 148/439; 148/440; 420/546

[58] Field of Search ..... 420/534, 546, 548; 148/415, 437, 439, 440

[56] References Cited

U.S. PATENT DOCUMENTS

| | | | |
|---|---|---|---|
| 3,627,518 | 12/1971 | Lawrence et al. | 148/440 |
| 3,868,250 | 2/1975 | Zimmermann | 148/439 |
| 4,284,429 | 8/1981 | Savas | 148/439 |
| 4,364,159 | 12/1982 | Holcombe | 92/222 |
| 4,619,712 | 10/1986 | Miyamoto | 148/440 |
| 4,969,428 | 11/1990 | Donahue et al. | 420/534 |

FOREIGN PATENT DOCUMENTS

| | | | |
|---|---|---|---|
| 1201562 | 9/1965 | Fed. Rep. of Germany | 420/546 |
| 1483229 | 12/1973 | Fed. Rep. of Germany . | |
| 1608165 | 5/1974 | Fed. Rep. of Germany . | |
| 3702721 | 8/1987 | Fed. Rep. of Germany . | |

OTHER PUBLICATIONS 31-0581: Mishima et al., "Superplasticity of Strip Cast Aluminum Alloys", Metals Abstr., vol. 19 (Feb. 1986) (J. Jpn. Inst. Light Met.), p. 57.

J. E. Hatch, Aluminum, "Properties and Physical Metallurgy", vol. 1, 1984, pp. 320–351, American Society for Metals.

*Primary Examiner*—George Wyszomerski

*Attorney, Agent, or Firm*—Sprung, Horn, Kramer & Wood

[57] ABSTRACT

Shaped bodies which are improved in high-temperature strength, resistance to thermal shock and fatigue limit can be made of a lightweight cast material which consists mainly of aluminum and in addition contains 5 to 15% by weight magnesium silicide.

5 Claims, 1 Drawing Sheet

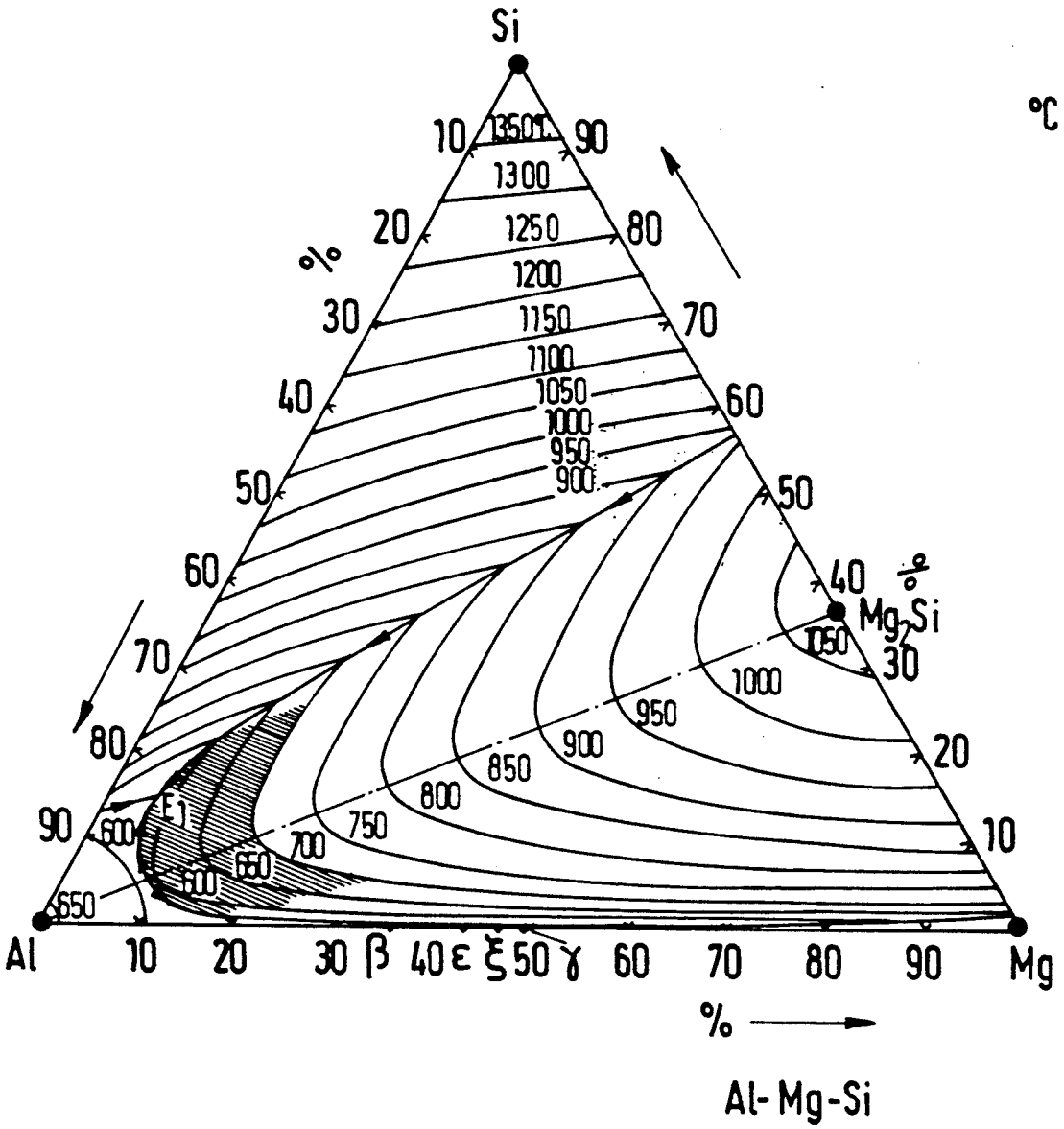
Si
°C
1350
1300
1250
1200
1150
1100
1050
1000
950
900
850
800
750
700
650
600
E1
Mg2Si
%
Al
Mg
β
ε
ξ
γ
Al-Mg-Si

LIGHTWEIGHT CAST MATERIAL

This application is a continuation of application Ser. No. 450,140, filed Dec. 13, 1989, now abandoned.

DESCRIPTION

This invention relates to a lightweight cast material which mainly consists of aluminum.

Current developments in internal combustion engine technology to increase the igniting pressures and thermal insulation of the combustion chamber in order to reduce the fuel consumption and the emission of pollutants have had strong influences on the use of lightweight materials which consist mainly of aluminum. Suitable measures of design must be adopted and the carrying capacity of said materials must be increased.

Many conventional lightweight cast materials consisting mainly of aluminum, such as aluminum-silicon piston alloys, have reached the limits of their carrying capacity because above a temperature of about 300° C. they are hardly able to withstand relatively high mechanical and thermal loads for a prolonged time.

Pressure casting processes, in which the molten material which has been charged into the casting mold is caused to solidify under a high pressure above 1000 bars, will result in a fine structure, by which the resistance of aluminum-silicon alloys to thermal cycling can slightly be increased but cannot sufficiently be increased (periodical Metall 30, 1976, pages 46 to 54).

A comparatively higher resistance to mechanical and thermal loads is exhibited by aluminum-silicon alloys having a matrix which is reinforced by, e.g., 20% by volume fibers consisting, e.g., of $Al_2O_3$, carbon, steel and the like, or whiskers, e.g., of SiC or the like. Pressure casting is eminently suitable for making such fiber-containing composite materials (Bader, M. G.: Alumina-fibre reinforced aluminum alloy castings for automotive applications, Proc. of the Int. Ass. for Vehicle Design, Vol. 2, 1984). But the production of fiber-containing composite materials is comparatively expensive.

Ceramic materials can be expected to have a much higher high-temperature strength and to exhibit a more favorable corrosion behavior. But the mass production of intricate ceramic components, such as monolithic pistons or turbine blades, involves problems which have not been solved yet. Besides, the use of ceramics in internal combustion engines is inherently restricted by the high susceptibility of ceramics to indentation, mechanical shock and thermal cycling. Besides, ceramics undesirably add to the weight and they can be shaped only with a considerable expenditure and their manufacture involves considerable costs.

Materials which consist of intermetallic phases possess the properties of metallic and ceramic materials in combination. For instance, they have a high thermal conductivity, a high melting temperature and in some cases a satisfactory ductility. For this reason they can apparently fill the gap between the conventional lightweight metallic materials consisting mainly of aluminum and the ceramic materials which have a high strength at elevated temperatures but are brittle. This is of special interest as regards gas turbines and internal combustion engines, in which improved materials would permit the operating temperatures and, as a result, the thermal efficiency, to be increased.

Intermetallic phases have been used in light alloy pistons of aluminum-silicon alloys, provided that such phases will be precipitated as a result of arc welding adjacent to the first piston ring groove when part of the matrix material is melted and mixed with nickel or copper materials. Hard intermetallic phases and primarily silicon are embedded in a highly super-saturated matrix of an aluminum solid solution so that a high resistance to wear is achieved (U.S. Pat. No. 4,562,327).

DE-A-3 702 721 teaches to produce shaped bodies having a high strength at elevated temperatures from an intermetallic phase alloy, which contains magnesium silicide and may contain additions of up to 42% by weight aluminum and/or up to 22% by weight silicon. The optimum composition of that alloy is represented in the phase diagram of the ternary system aluminum-magnesium-silicon by an area which is defined by the eutectic trough, the quasi-binary section and 42% by weight aluminum. That lightweight cast material has the disadvantage that it is not always possible to prevent during the solidification of the residual molten material in the casting the formation of gas-filled pores owing to the gases which are dissolved in the molten material and are released as the solidification results in a decrease of the solubility.

It is an object of the invention to provide a lightweight cast material which consists mainly of aluminum and can be cast under conditions which are similar to those employed in the casting of conventional aluminum piston alloys, e.g., of an alloy of the type AlSi12-CuNiMg, i.e., can be cast at temperatures of 700° to 750° C., and has a liquidus temperature of 560° to 700° C., a solidus temperature of 550° to 600° C. and a coefficient of expansion below $20\times10^{-6}\,K^{-1}$.

That object is accomplished by a lightweight cast material which consists mainly of aluminum and in addition contains 5 to 25% by weight magnesium silicide. That lightweight material has a primary structure consisting of magnesium silicide and in addition contains a binary Al—$Mg_2Si$ eutectic alloy and/or a ternary Al—$Mg_2Si$—Si eutectic alloy.

Whereas it has been mentioned by L. F. Mondolfo in Aluminum Alloys: Structure and Properties, London 1976, page 787, that aluminum alloys may contain up to about 2% by weight magnesium silicide, such aluminum alloys cannot be deformed above said limit and there is no mention in that printed publication of lightweight cast materials which contain an addition of $Mg_2Si$.

To improve the ductility the lightweight cast material in accordance with the invention may be grain-refined by an addition of silicon in an amount of up to 12% by weight, preferably of 0.5 to 10% by weight, although primary silicon must not occur.

In accordance with a further feature of the invention the silicon can be replaced entirely or in part by magnesium in an amount of up to 15% by weight, preferably of 5 to 12% by weight.

A preferred composition of the lightweight cast material which consists mainly of aluminum is represented in the phase diagram of the ternary system aluminum-magnesium-silicon by an area which extends on both sides of the quasi-binary section Al/$Mg_2Si$ and is defined by the liquidus temperature of 700° C. and by the primary solidification range of magnesium silicide.

The precipitation hardening of the lightweight material can considerably be accelerated by an addition of one or more of the elements manganese, copper, nickel and cobalt in an amount of up to 5% by weight, preferably of 0.05 to 2% by weight.

The lightweight material in accordance with the invention, which consists mainly of aluminum, is produced by conventional casting processes either in that magnesium silicide is charged into molten aluminum or in that magnesium and silicon are separately added to the molten material.

In the following table the properties which can be achieved in accordance with the invention have been compared with the properties of a cast aluminum piston alloy of the type AlSi122CuMgNi. It is seen that the lightweight material having the composition Al80—$Mg_2Si$20 has a lower coefficient of expansion amounting to $19.8\times10^{-6}K^{-1}$. The thermal conductivity amounting to 173 W/mK exceeds the thermal conductivity of the conventional piston alloy. The lightweight material has a lower density of about 2.51 g/cm$^3$. The lightweight material has a higher stiffness represented by a modulus of elasticity of 83 GPa. The remaining mechanical strength properties can be influenced by the structure and the heat treatment.

| Properties | AlSi12CuMgNi | Al with 20% by weight $Mb_2Si$ |
|---|---|---|
| Coefficient of expansion ($10^{-6}K^{-1}$) | 20.5 to 21.5 | 19.8 |
| Thermal conductivity ($Wm^{-1}K^{-1}$) | 155 | 173 |
| Density (g/cm$^3$) | 2.70 | 2.51 |
| Modulus of elasticity (GPa) | 78 | 83 |

BRIEF DESCRIPTION OF THE DRAWING

In the phase diagram of the ternary system aluminum-magnesium-silicon shown on the drawing the composition of the lightweight material which consists mainly of aluminum and is of particular interest for a technological use as a piston material is represented by a hatched area which lies on both sides of the quasi-binary section Al/$Mg_2Si$ between the liquidus temperature of 700° C. and the primary solidification range of magnesium silicide.

We claim:

1. A lightweight cast material having compact $Mg_2Si$ first phase primary particles, and Al—$Mg_2Si$ eutectic alloy second phase particles, said material consisting essentially of aluminum and 5 to 25% by weight of magnesium silicide, silicon in an amount of 1 to 12% by weight and magnesium in a solid solution in an amount of 5 to 15% by weight.

2. A lightweight cast material according to claim 1 which contains at least one of the elements manganese, copper, nickel and cobalt in an amount of up to 5% by weight.

3. A lightweight cast material according to claim 1 which contains at least one of the elements manganese, copper, nickel and cobalt in an amount of 0.05 to 2% by weight.

4. A piston cast of a material according to claim 1.

5. A lightweight cast material having compact $Mg_2Si$ first phase primary particles, Al—$Mg_2Si$ eutectic alloy second phase particles, and Al—$Mg_2Si$—Si eutectic alloy third phase particles, said material consisting essentially of aluminum and 5 to 25% by weight of magnesium silicide, silicon in an amount of 1 to 12% by weight and magnesium in a solid solution in an amount of 5 to 15% by weight.

* * * * *